US006736454B1

(12) United States Patent
Sardo

(10) Patent No.: US 6,736,454 B1
(45) Date of Patent: May 18, 2004

(54) PADDED VANDALISM RESISTANT DISPOSABLE VEHICULAR SEATING INSERT SYSTEM

(76) Inventor: Louis Sardo, 512 W. Rosecrans Ave., Gardena, CA (US) 90248

( * ) Notice: Subject to any disclaimer, the term of this patent is extended or adjusted under 35 U.S.C. 154(b) by 0 days.

(21) Appl. No.: 09/961,978

(22) Filed: Sep. 24, 2001

(51) Int. Cl.[7] ..... A47C 27/00
(52) U.S. Cl. ..... 297/229; 5/653; 297/452.55
(58) Field of Search ..... 297/219.1, 228.13, 297/229, 232, DIG. 6, 452.48, 452.55, 452.58, 452.59, 461, 440.14, 452.57, 452.6; 5/653, 411, 655.9, 922

(56) References Cited

U.S. PATENT DOCUMENTS 3,111,689 A * 11/1963 Mulhauser, Jr.
3,198,578 A * 8/1965 Geoffrey et al.
3,556,594 A * 1/1971 Anderson
3,685,063 A 8/1972 Morgan ..... 5/345
3,797,887 A * 3/1974 Barecki et al.
3,801,154 A * 4/1974 Hultquist et al.
3,873,155 A 3/1975 Barecki ..... 297/445
4,527,832 A 7/1985 McMains et al. ..... 297/355
4,583,782 A 4/1986 Mikuniya ..... 297/440
4,607,887 A * 8/1986 Vail
4,917,931 A * 4/1990 McDowell et al.
4,955,095 A * 9/1990 Gerrick
5,061,539 A * 10/1991 McDowell et al.
5,403,066 A 4/1995 Drum ..... 297/219.1
5,405,179 A * 4/1995 Jih
5,407,247 A * 4/1995 Forcier et al.
5,487,587 A * 1/1996 Hylton
5,503,454 A * 4/1996 Sakamoto
5,704,691 A * 1/1998 Olson ..... 297/452.55
5,826,939 A * 10/1998 Beyer
6,135,562 A 10/2000 Infanti ..... 297/440.2

* cited by examiner

*Primary Examiner*—Peter M. Cuomo
*Assistant Examiner*—Stephen Vu
(74) *Attorney, Agent, or Firm*—Goldstein Law Offices, P.C.

(57) ABSTRACT

A seat insert for mounting to a fixed seat, the insert having a rigid spine, having a periphery, a back surface, a front surface which is laminated with a soft fabric, and has securing device on the back surface disposed about the periphery for allowing the back surface to be mounted to the fixed seat. A cushion is attached to the back surface of the spine such that the cushion extends between the back surface of the spine and the fixed seat when the back surface is mounted to the fixed seat.

8 Claims, 5 Drawing Sheets

PADDED VANDALISM RESISTANT DISPOSABLE VEHICULAR SEATING INSERT SYSTEM

FIELD OF THE INVENTION

The invention relates to a padded, vandalism resistant, disposable vehicular seating insert system. More particularly, the invention relates to a seat bottom and seat-back insert which may detachably secured to a vehicular seat, providing an addition level of comfort thereto, while resisting destruction from vandals.

BACKGROUND OF THE INVENTION

Traditional vehicular seats, namely those, seats employed by commuter buses and coaches, are often comprised of a hard material such as fiberglass or high-impact synthetic resins and plastics. These materials are often employed due to their resilient nature—they are not vulnerable to destruction due to intentional vandalism or high-volume commuter wear and tear. Furthermore, seats of this construction are also easily maintained in that they may be readily scrubbed with harsh abrasives to remove stains and markings, without obvious damage to the seat's finish.

However, while seats of this construction are easily maintainable, they tend to fail to provide even the slightest level of comfort to a commuter seated thereupon. The rigid construction can cause upper and lower back pains after short periods of time, as well as discomfort to the user's buttocks and thighs. A seating surface which employs softer and more cushioned seating surfaces is needed. Unfortunately, to construct commuter bus or coach seats of a more flexible and soft supple cloth-like material, as is often encountered in small passenger vehicles is not feasible since these types of seats are easily damaged, cut, and marred. To replace an entire such seat assembly in response to damage, cutting or marring would be extremely cost prohibitive. Accordingly, a device or system is needed which permits a commuter bus or coach seat to provide comfort to a user, without all of the problems inherent in the systems mentioned above.

In recent years, seating inserts have been used which a rigid spine is covered with a fabric, carpet-like pile, and then is attached to the seat frame. Such inserts marginally improve the comfort for the rider. In addition, because the fabric covering is glued directly to the rigid spine, a vandal can perhaps scrape through the fabric with a knife, but the rigid spine will prevent the vandal from doing little more than making a fine cut-line in the fabric pile.

The problem with such inserts, is that although the fabric pile provides a more attractive seat, which is soft on the surface, it fails to provide adequate cushioning for the rider. The obvious solution would be to provide a cushion between the fabric pile and the rigid spine. However, a simple cut from the vandal's knife would destroy such a seat. Accordingly, attempts to cushion such an insert have been coupled with attempts to prevent a vandal's knife from moving through the cushion—such as by putting a metal mesh within the foam, or a metal mesh in the fabric covering. All such attempts are easily defeated with sufficient strength and determination on the part of the vandal, and thus have been largely unsuccessful.

While these prior art units described herein may be suitable for the particular purpose employed, or for general use, they would not be as suitable for the purposes of the present invention as disclosed hereafter.

SUMMARY OF THE INVENTION

The present invention relates to a padded vehicular seating insert system. More particularly, the invention relates to a seat bottom and seat-back insert which may be detachably secured to a fixed vehicular seat, providing an addition level of comfort thereto.

In accordance with the invention, there is provided a seat insert which may be easily removed from a bus or coach seat in the event said insert needs to be cleaned or replaced.

Further in accordance with the invention, there is provided a seat insert which employs a rigid, vandal resistant plate, but still has enhanced comfort, by providing a cushion in addition to the fabric pile which covers the rigid plate.

Further in accordance with the invention, there is provided a seat insert which comprises a hard, plastic, rigid spine which is laminated with fabric, and has securing means disposed on the rear of said hard plastic spine, said securing means configured to engage mating securing means which are similarly disposed about the periphery of the seating surface to which the insert is to be affixed. The cushion is located on the rear surface of the spine so that it is not subject to vandalism.

To the accomplishment of the above and related objects the invention may be embodied in the form illustrated in the accompanying drawings. Attention is called to the fact, however, that the drawings are illustrative only. Variations are contemplated as being part of the invention, limited only by the scope of the claims.

BRIEF DESCRIPTION OF THE DRAWINGS

In the drawings, like elements are depicted by like reference numerals. The drawings are briefly described as follows.

DETAILED DESCRIPTION OF THE PREFERRED EMBODIMENTS

Figure 1:
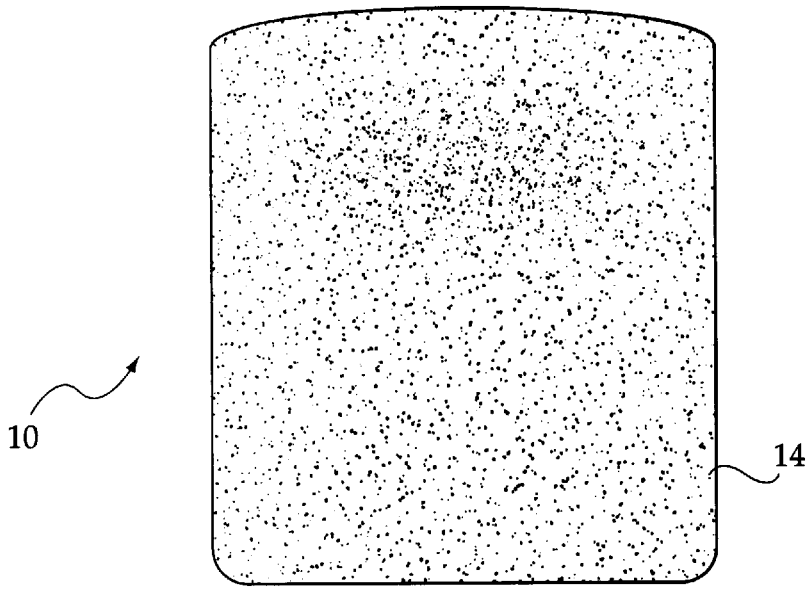
FIG. 1 is a top plan view of the seat insert of the instant invention.

Certain terminology is used in the following description for convenience only and is not limiting. The words "right," "left," "lower" and "upper" designate directions in the drawings to which reference is made. The words "inwardly" and "outwardly" refer to directions toward and away from, respectively, the geometric center of the seat insert. The words "proximal end" and "distal end" refer, respectively, to ends of an object nearer to and further from the operator of the object when the object is used in a normal fashion or as is described in the specification.

In its most general terms, the invention is an insert 10, which includes a rigid spine 12, a fabric covering 14, and a cushion 15, which are each present throughout the drawing figures. In particular, the rigid insert 12 has a front surface 12F which is mostly covered in the drawing figures, and a rear surface 12R which is visible in some others, and has a periphery 12P.

Figure 2:
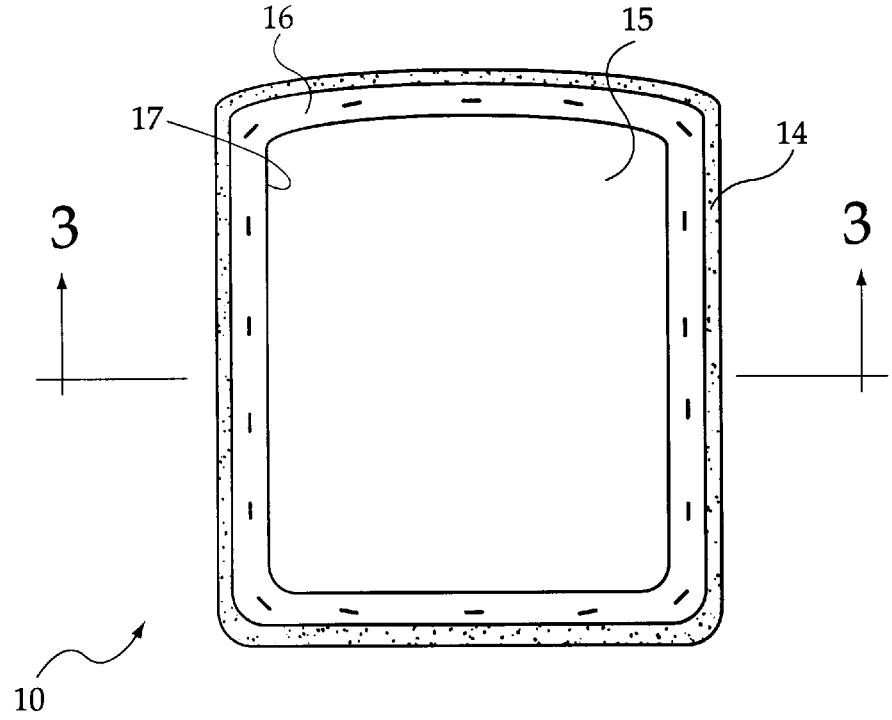
FIG. 2 is a bottom plan view of a flat version of the invention, showing the rear surface of the rigid spine of the seat insert of the instant invention.
Figure 3:
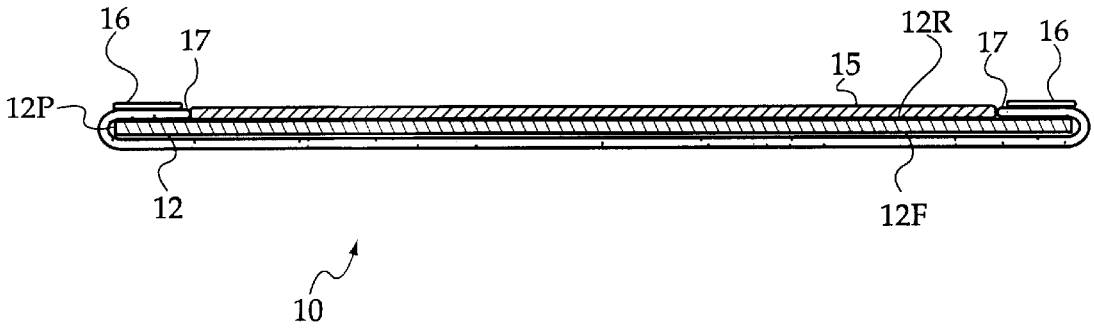
FIG. 3 is a cross section view, taken generally along line 3—3 of FIG. 2.

FIG. 1 illustrates a top plan view of the seat insert 10 of the instant invention, while FIG. 2 illustrates a bottom plan view thereof. Reference to FIGS. 1 and 2 along with the cross section view of FIG. 3 show the rigid spine 12 of the insert 10, which is generally plate-like and made of a hard plastic material. The rigid spine 12 is upholstered (covered) with the soft fabric covering 14, which is generally a carpet-like wool pile. The fabric covering 14 which upholsters the spine 12 can be seen in the front view of FIG. 1 as fully covering the front surface of the hard plastic spine 12 which is then fully obscured in FIG. 1. The fabric covering is also seen in FIG. 2 and FIG. 3 as extending partially onto the rear surface 12R, creating a border 17 which extends substantially parallel to the periphery 12P, and which creates a central cavity therewithin. As seen in FIG. 3, the cushion 15 is affixed to the rear surface 12R of the rigid spin 12, within the central cavity.

Further, strips of securing means 16 such as hook and loop fasteners 16 are disposed on the rear surface 12R of the rigid spine 12. They are positioned on top of the fabric covering 14 as it wraps around to the rear surface 12R and creates the border 17. Thus, as seen in FIG. 8, the border 17 is actually created by the fabric covering 14 and the hook and loop fasteners of the securing means 16.

Figure 8:
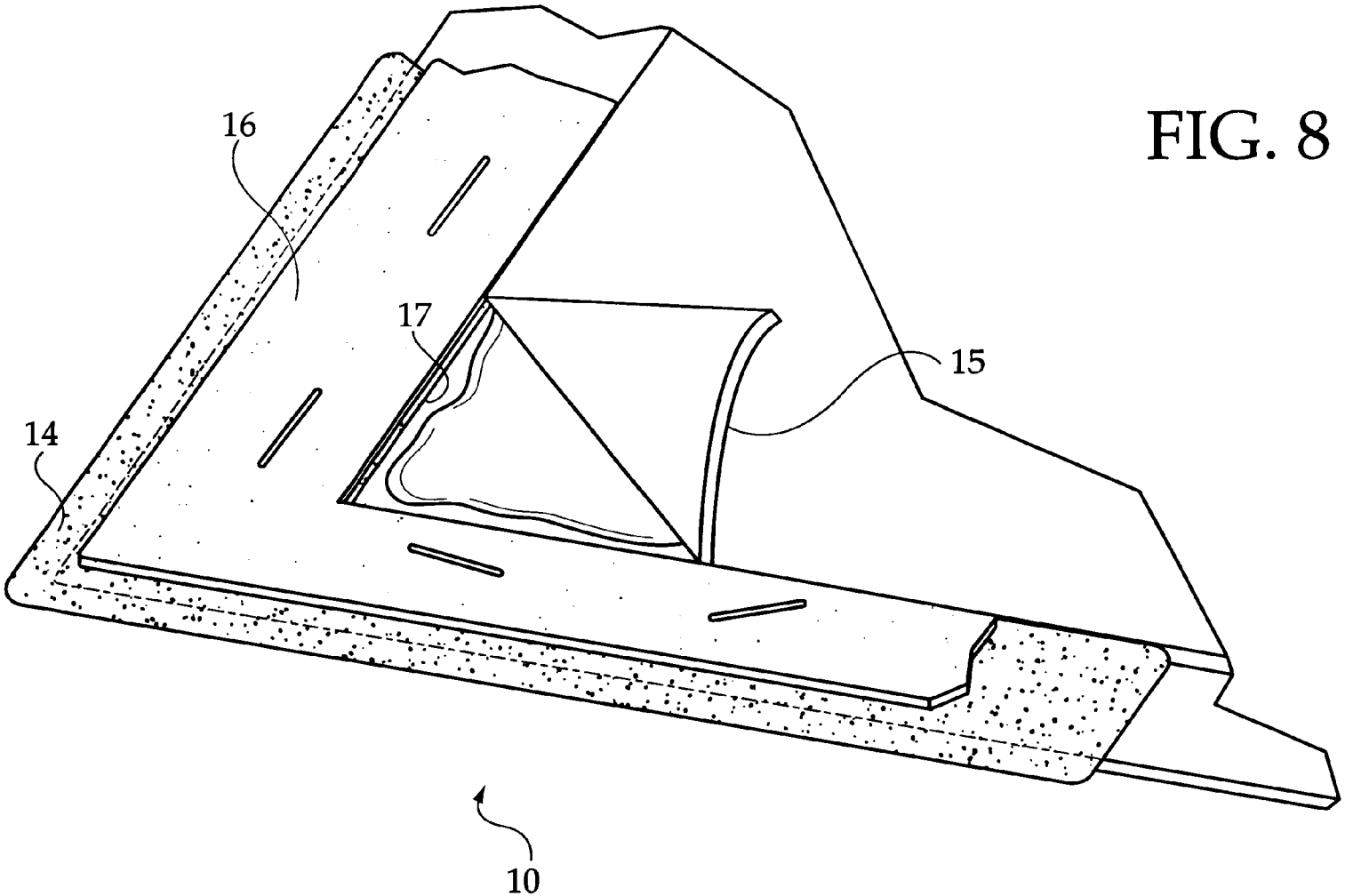
FIG. 8 is an enlarged perspective view, illustrating the fabric covering, securing means, and cushion, attached onto the rear surface of the rigid spine.

FIG. 8 further details construction of the insert 10, wherein the border 17, comprised of the covering 14 and the securing means 16 at the rear surface 12R, has a border thickness which is substantially equivalent to a thickness of the cushion 15, such that the insert 10 is substantially flush at its rear, with the cushion 15 at substantially the same height from the spine rear surface 12R as the combined covering 14 and securing means 16. Preferably, ¼" water resistant foam is preferably used for the cushion 15, although the foam could be substituted in numerous ways, such as with rubber, a waffled plastic pad, or spring netting. Also detailed in FIG. 8, generally the securing means 16 and covering 14 are fastened directly to the spine 12 with fastening devices, such as staples 19, as illustrated. Further, the covering 14 is glued at the front surface 12F and the cushion 15 is glued to the rear surface 12R.

Figure 7:
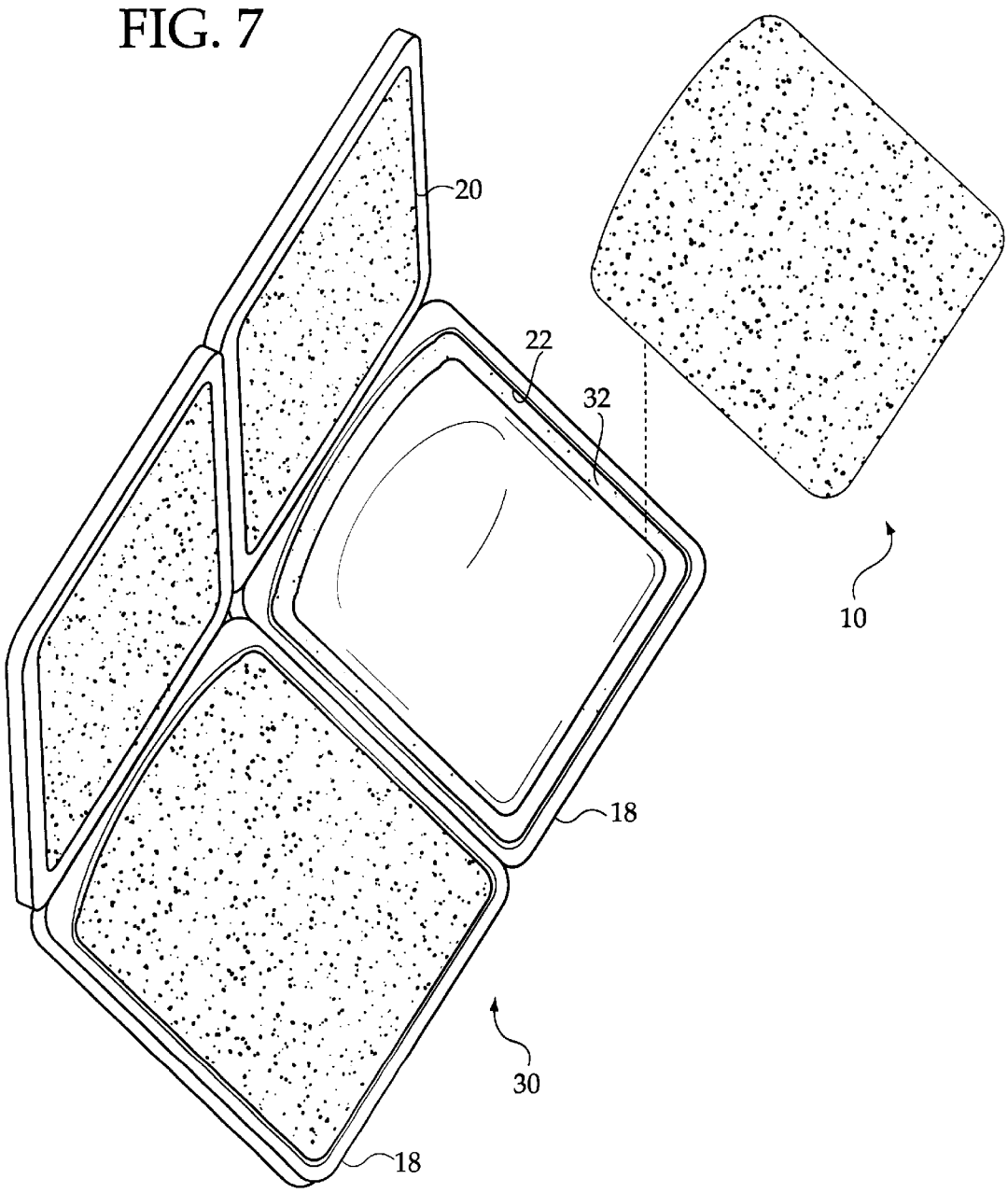
FIG. 7 is a perspective view, illustrating the seat insert about to be installed to a fixed seat of a public transportation vehicle.

FIG. 7 illustrates a typical fixed bus seat 18, which may be present on a bus, a train, or other public conveyance or public vehicle. Generally the seat 18 is contained in a seating unit 30, which includes multiple individual seats. The seat 18 comprises a vertical hollow 20 and a horizontal hollow 22, which are typically a concave area within the seat, where the back and buttocks are positioned when in use. Each of said hollows 20 and 22 has securement means 32 which engage the securing means 16 attached to the rear surface 12R of the rigid spine 12 of the seat insert 10. For instance, male hook and loop fasteners 16 can be used on the seat 18 while mateable female hook and loop fasteners 16 are used on the seat insert 10 to allow simple installation and removal of the seat insert 10 into one of the hollows of the bus seat 18. Accordingly, said seat insert 10 may be changed at will in response to maintenance needs or the desire to vary the color or pattern thereof. When installed, said seat inserts 10 provide an additional level of comfort and support compared to the standard fixed bus seat 18. The seat insert 10 may optimally be installed upon both the top member 20 and bottom member 22 of the standard bus or coach seat 18.

Once installed, the cushion 15 provides additional comfort for the user. Although contact with the rigid spine 12 by the passenger is not itself softened by the cushion 15—even the small travel (generally ¼") afforded by the cushion goes a long way to absorb vibration, shocks during motion of the vehicle—and unexpectedly provides significant comfort to the passenger seated thereupon.

Figure 4:
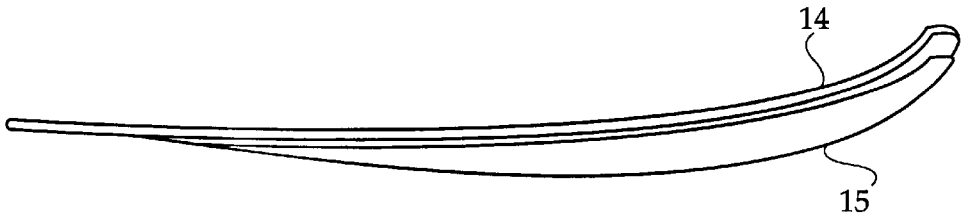
FIG. 4 is a side elevational view of the seat insert, having a curvature which facilitates its use with existing fixed seats commonly in use in public transportation vehicles.
Figure 5:
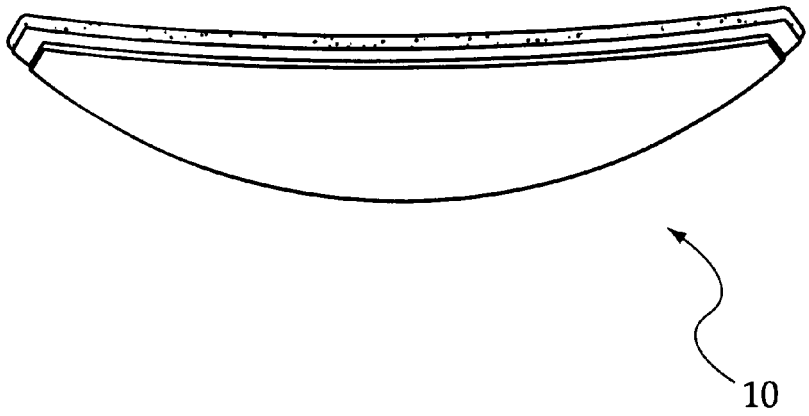
FIG. 5 is a rear elevational view thereof.
Figure 6:
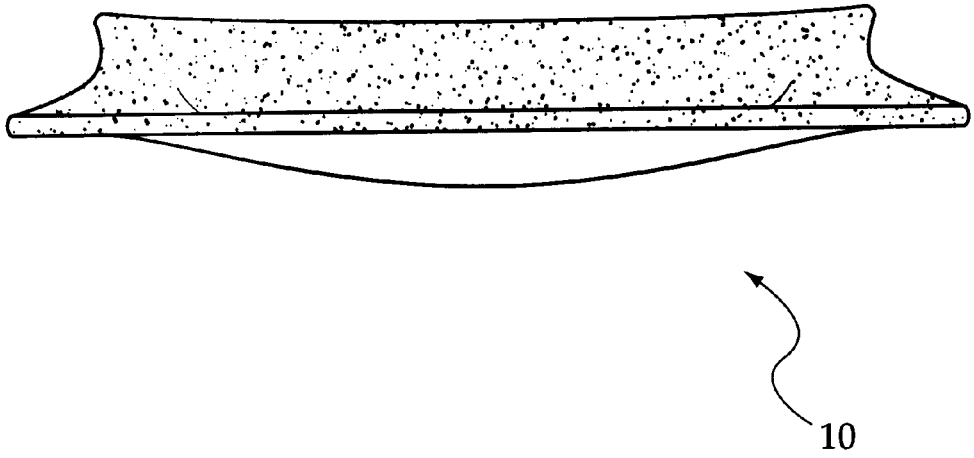
FIG. 6 is a front elevational view thereof.

FIGS. 1, 2, 3, and 8 generally illustrate a flat version of the insert 10. However, as seen in FIG. 7, generally the hollows 20 and 22 in the seats 18 are concave. Thus, as seen in FIGS. 4, 5, and 6, the insert 10 is typically made to be concave, to fit snugly within the hollows 20 and 22. Accordingly, the rigid plate 22 is formed in a concave shape to conform with the hollows 20 and 22. Then the covering 14, the securing means 16 and the cushion 15 are conformed and attached to the rigid plate 22.

In conclusion, herein is presented a seating insert with use with a fixed vehicle seat, wherein a cushion is provided to enhance comfort without sacrificing the vandal resistance of the insert. This concept is embodied in the form illustrated in the accompanying drawings. However such drawings are illustrative only. Numerous variations may be made while adhering to the inventive concept. Such variations are contemplated as being a part of the present invention.

What is claimed is:

1. A seating insert for use with a fixed vehicle seat having a securement means thereon, comprising:

a rigid spine having a front surface, a rear surface, and a periphery;

a fabric covering upholstered across the front surface of said rigid spine;

a cushion, attached to the rear surface of the spine; and a securing means on the rear surface of the rigid spine, fastenable to the securement means on the vehicle seat for attaching the rear surface to the vehicle seat.

2. The seating insert of claim 2, wherein said securement means on the vehicle's seat is a hook and loop fastener, and wherein the securing means of the seating insert is a hook and loop fastener, such that the hook and loop fasteners can engage between the seating insert and vehicle seat for affixing the seating insert to the vehicle seat.

3. The seating insert of claim 2, wherein the fabric covering wraps around the periphery from the front surface onto the rear surface of the spine and is secured onto said rear surface, creating a border substantially parallel to said periphery and protruding from the rear surface, and wherein the cushion is affixed to the rear surface within the border.

4. The seating insert of claim 3, wherein the securing means is affixed atop the border, enhancing the thickness of the border from the spine, and wherein the cushion extends within the border and has a thickness substantially equivalent to the combined thickness of the fabric material and securing means on the back surface.

5. A seating insert for use with a fixed vehicle seat, comprising:

a rigid spine having a front surface, a rear surface, and a periphery;

a fabric covering upholstered across the front surface of said rigid spine, the fabric covering wraps around the periphery from the front surface onto the rear surface of the spine and is secured onto said rear surface, creating a border substantially parallel to said periphery and protruding from the rear surface;

a cushion, attached to the rear surface of the spine within the border; and a securing means on the rear surface of the rigid spine, for attaching the rear surface to the vehicle seat.

6. The seating insert of claim 5, wherein the vehicle seat has a securement means thereon, and wherein the securing means of the seating insert is fastenable to the securement means on the vehicle seat.

7. The seating insert of claim 6, wherein said securement means on the vehicle seat is a hook and loop fastener, and wherein the securing means of the seating insert is a hook and loop fastener, such that the hook and loop fasteners can engage between the seating insert and vehicle seat for affixing the seating insert to the vehicle seat.

8. The seating insert of claim 7, wherein the securing means is affixed atop the border, enhancing the thickness of the border from the spine, and wherein the cushion extends within the border and has a thickness substantially equivalent to the combined thickness of the fabric material and securing means on the back surface.

* * * * *